US008510907B2

(12) United States Patent
Conrad

(10) Patent No.: US 8,510,907 B2
(45) Date of Patent: Aug. 20, 2013

(54) CYCLONIC SURFACE CLEANING APPARATUS

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 555 days.

(21) Appl. No.: 12/721,480

(22) Filed: Mar. 10, 2010

(65) Prior Publication Data

US 2010/0229328 A1 Sep. 16, 2010

(30) Foreign Application Priority Data

Mar. 11, 2009 (CA) ..... 2658006

(51) Int. Cl.
*A47L 9/10* (2006.01)
*A47L 9/20* (2006.01)

(52) U.S. Cl.
USPC ..... 15/348; 15/352; 15/353; 15/327.7

(58) Field of Classification Search
USPC ..... 15/344, 352, 347, 348, 353, 327.7; 55/337, 429, 345, DIG. 3
See application file for complete search history.

(56) References Cited

U.S. PATENT DOCUMENTS

| | | | | |
|---|---|---|---|---|
| 5,267,371 | A * | 12/1993 | Soler et al. | 15/327.5 |
| 6,434,785 | B1 | 8/2002 | Vandenbelt et al. | |
| 6,502,278 | B2 * | 1/2003 | Oh et al. | 15/353 |
| 6,810,558 | B2 * | 11/2004 | Lee | 15/353 |
| 7,370,387 | B2 | 5/2008 | Walker et al. | |
| 7,691,161 | B2 * | 4/2010 | Oh et al. | 55/337 |
| 7,717,973 | B2 * | 5/2010 | Oh et al. | 55/337 |
| 7,882,593 | B2 * | 2/2011 | Beskow et al. | 15/353 |
| 7,922,794 | B2 * | 4/2011 | Morphey | 95/271 |
| 7,958,598 | B2 * | 6/2011 | Yun et al. | 15/353 |
| 7,996,956 | B2 * | 8/2011 | Wood et al. | 15/347 |
| 8,100,999 | B2 * | 1/2012 | Ashbee et al. | 55/343 |
| 8,101,001 | B2 * | 1/2012 | Qian | 55/441 |
| 8,117,712 | B2 * | 2/2012 | Dyson et al. | 15/344 |
| 8,146,201 | B2 * | 4/2012 | Conrad | 15/353 |
| 8,151,407 | B2 * | 4/2012 | Conrad | 15/327.2 |
| 8,156,609 | B2 * | 4/2012 | Milne et al. | 15/344 |
| 2006/0090290 | A1 | 5/2006 | Lau | |
| 2007/0271724 | A1 | 11/2007 | Hakan et al. | |
| 2008/0040883 | A1 | 2/2008 | Beskow et al. | |
| 2008/0190080 | A1 | 8/2008 | Oh et al. | |

FOREIGN PATENT DOCUMENTS

| | | | |
|---|---|---|---|
| WO | 2008/009890 | A1 | 1/2008 |
| WO | 2008009883 | A1 | 1/2008 |
| WO | 2008009888 | A1 | 1/2008 |

* cited by examiner

*Primary Examiner* — Joshua J Michener
*Assistant Examiner* — Chi Q Nguyen
(74) *Attorney, Agent, or Firm* — Philip C. Mendes da Costa; Bereskin & Parr LLP/S.E.N.C.R.L., s.r.l.

(57) ABSTRACT

A surface cleaning apparatus comprises at least one cyclone and at least one dirt collection chamber. The dirt collection chamber has a removeably mounted door.

23 Claims, 11 Drawing Sheets

CYCLONIC SURFACE CLEANING APPARATUS

CROSS REFERENCE TO RELATED APPLICATIONS

This application claims the benefit of the filing date of Canadian Patent Application. No. 2658006 filed Mar. 11, 2009 entitled CYCLONIC SURFACE CLEANING APPARATUS.

FIELD

The specification relates to surface cleaning apparatus, and particularly, to cyclonic surface cleaning apparatus. In a particularly preferred embodiment, the specification relates to cyclonic hand vacuum cleaners having a dirt chamber with a removable door.

INTRODUCTION

The following is not an admission that anything discussed below is prior art or part of the common general knowledge of persons skilled in the art.

PCT publication WO 2008/009890 (Dyson Technology Limited) discloses a handheld cleaning appliance comprising a main body, a dirty air inlet, a clean air outlet and a cyclonic separator for separating dirt and dust from an airflow. The cyclone separator is located in an airflow path leading from the air inlet to the air outlet. The cyclonic separator is arranged in a generally upright orientation (i.e., the air rotates about a generally vertical axis in use). A base surface of the main body and a base surface of the cyclonic separator together form a base surface of the appliance for supporting the appliance on a surface. See also PCT publication WO 2008/009888 (Dyson Technology Limited) and PCT publication WO 2008/009883 (Dyson Technology Limited).

U.S. Pat. No. 7,370,387 (Black & Decker Inc.) discloses a hand-holdable vacuum cleaner that uses one or more filters and/or cyclonic separation device. and means for adjusting an angle of air inlet relative to a main axis of said vacuum cleaner. In particular, the vacuum cleaner further comprises a rigid, elongate nose having the air inlet at one end thereof, the nose being pivotal relative to a main axis of the vacuum cleaner through an angle of at least 135 degrees.

SUMMARY

The following introduction is provided to introduce the reader to the more detailed discussion to follow. The introduction is not intended to limit or define the claims.

According to one broad aspect, a surface cleaning apparatus is disclosed wherein the apparatus has a dirt chamber with a removable door. Cyclonic vacuum cleaners have been designed wherein a dirt chamber is provided for collecting dirt separated by a cyclone wherein the dirt chamber has a door that is removably mounted. For example, the surface cleaning apparatus may utilize at least one cyclone having one or more associated dirt collection chambers. The dirt chamber may be a lower portion of the cyclone chamber or external thereof. For example, the dirt chamber may be connected in flow communication with the cyclone chamber by one or more outlets, such as in a sidewall or an open bottom of a cyclone casing. In accordance with this aspect, the door is removably mounted.

In some designs a cyclone chamber has an open end and a separation plate is positioned opposed to and facing the open end. The separation plate may be positioned on the door. If the door is pivotally mounted, then even when the door is fully open, the separation plate may impede the emptying of dirt in the dirt collection chamber and/or the cyclone chamber. Further, if dirt accumulates in a space between the door and the separation plate, it may be difficult for a consumer to empty dirt in that region, especially if the door has an annular lip around the perimeter of the door. An advantage of using a removable door is that a separation plate provided on the door will be removed from the surface cleaning apparatus and will not block any portion of the cyclone chamber and/or dirt collection chamber. Further, a consumer may wash the door and the separation plate thereby removing any accumulated dirt.

For example, in accordance with this aspect, a surface cleaning apparatus may comprise a front end, a rear end with an air flow passage extends from a dirty air inlet to a clean air outlet. A first cyclone unit may be positioned in the air flow passage. The first cyclone unit may comprise at least one cyclone and at least one dirt collection chamber. The dirt collection chamber has a removably mounted door. A suction motor is positioned in the air flow passage.

In some examples, the at least one dirt collection chamber is openable when mounted to the surface cleaning apparatus.

In some examples, the surface cleaning apparatus comprises a hand vacuum cleaner and the door is positioned at the front end.

In some examples, the surface cleaning apparatus comprises a hand vacuum cleaner and the first cyclone unit is positioned forward of the suction motor.

In some examples, the surface cleaning apparatus comprises a hand vacuum cleaner, the at least one cyclone has a cyclone front end, a cyclone rear end, a cyclone air inlet and a cyclone air outlet, and the cyclone air inlet and the cyclone air outlet are at the same end.

In some examples, the cyclone air inlet and the cyclone air outlet are at the cyclone rear end.

In some examples, the at least one cyclone has a first end, a second end, a cyclone air inlet and a cyclone air outlet, and the cyclone air inlet and the cyclone air outlet are at the same end.

In some examples, the cyclone has a dirt outlet and a separation plate is mounted in facing relation to the dirt outlet.

In some examples, the surface cleaning apparatus comprises a hand vacuum cleaner, the cyclone has a dirt outlet and a separation plate is mounted in facing relation to the dirt outlet and the dirt outlet is positioned at the cyclone front end and the cyclone front end is positioned at the front end of the hand vacuum cleaner.

In some examples, the separation plate is mounted to the door.

In some examples, the dirt collection chamber is removable from the surface cleaning apparatus as a sealed unit for emptying.

In some examples, the first cyclone unit is sealed when removed from the surface cleaning apparatus other than fluid flow passages leading to and from the first cyclone unit.

In some examples, the dirt collection chamber is removable from the surface cleaning apparatus with the first cyclone unit.

In some examples, the first cyclone unit has a single cyclone and a single dirt collection chamber.

In some examples, the single dirt collection chamber is positioned exterior to the single cyclone.

In some examples, the single cyclone and the single dirt collection chamber comprise a one-piece assembly.

In some examples, the single cyclone and the single dirt collection chamber are integrally formed.

In some examples the surface cleaning apparatus further comprises a suction motor housing, the suction motor is positioned in the suction motor housing, and the first cyclone unit is removably mounted to the suction motor housing.

In some examples the surface cleaning apparatus further comprises an airflow chamber extending from a dirty air inlet and in communication with a cyclone inlet, wherein the airflow chamber is removable with the first cyclone unit.

In some examples, the airflow chamber is integrally formed as part of the first cyclone unit.

In some examples the surface cleaning apparatus further comprises a second cyclone unit downstream from the first cyclone unit.

It will be appreciated that a surface cleaning apparatus may incorporate one or more of the features of each of these examples.

In some examples the surface cleaning apparatus is a hand vacuum cleaner.

DRAWINGS

In the detailed description, reference will be made to the following drawings, in which.

DESCRIPTION OF VARIOUS EXAMPLES

Figure 1:
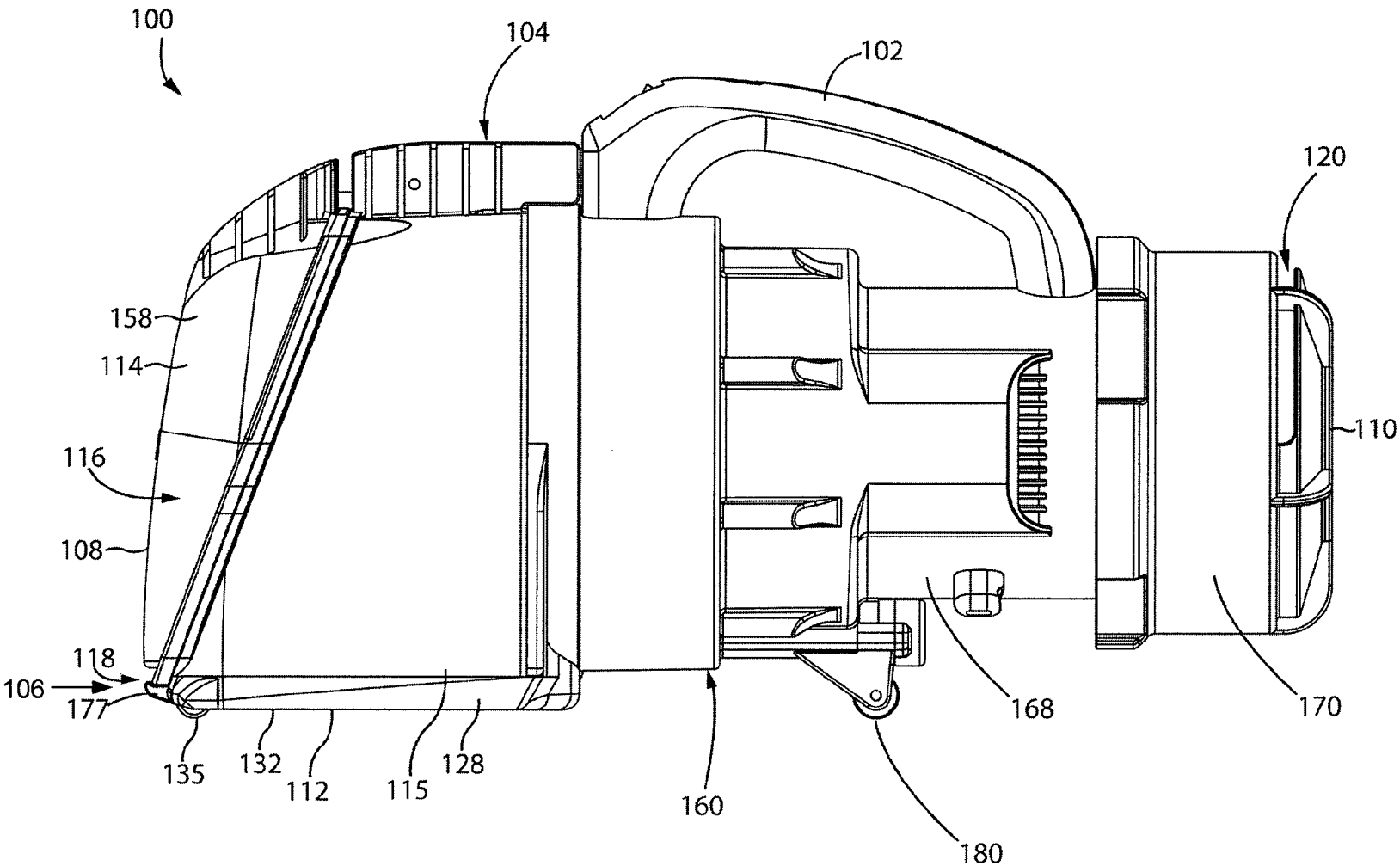
FIG. 1 is a side plan view of an example of a hand vacuum cleaner.
Figure 2:
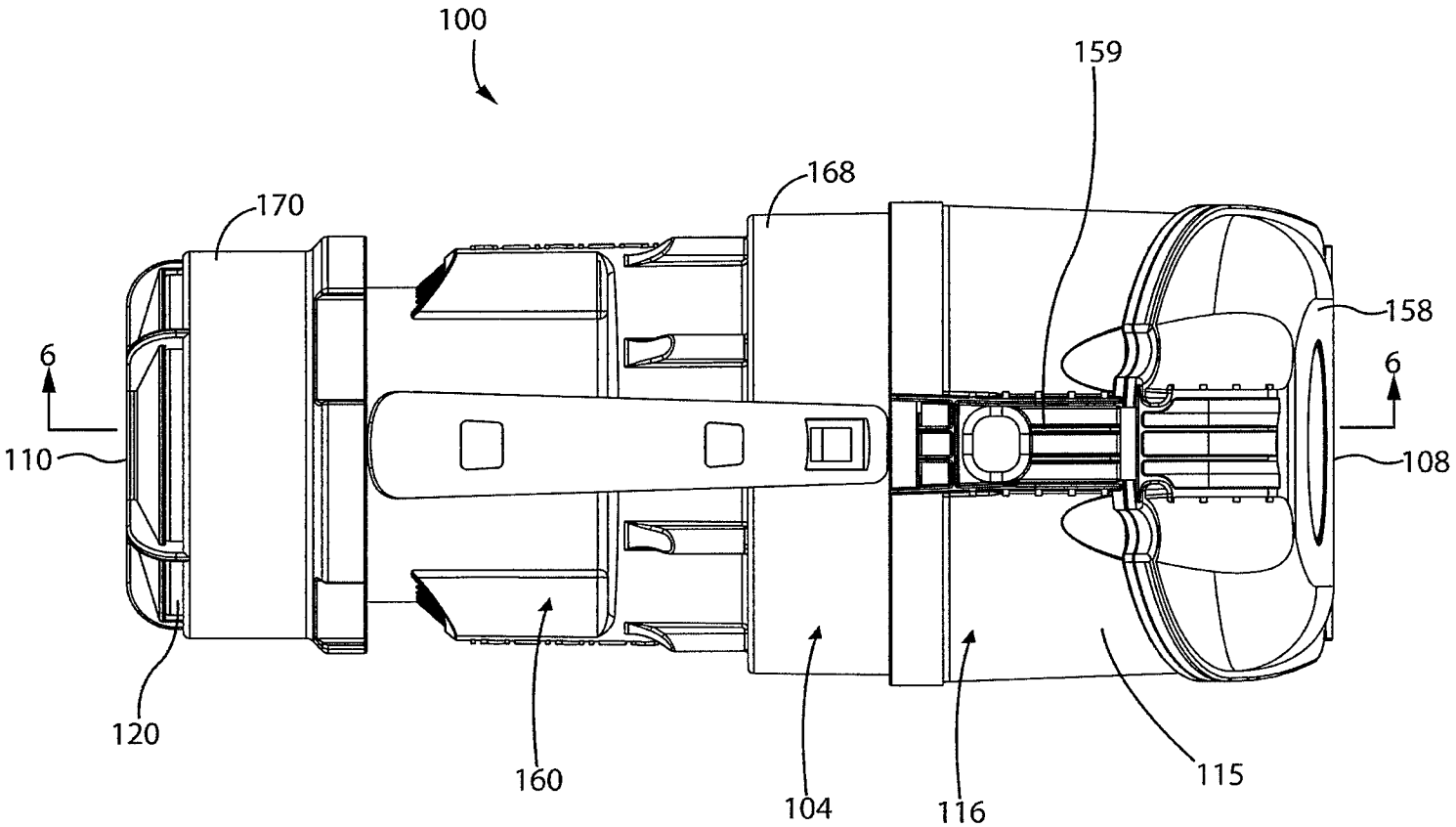
FIG. 2 is a top plan view of the hand vacuum cleaner of FIG. 1.

Various apparatuses or methods will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

In the drawings attached hereto, the surface cleaning apparatus is exemplified as used in a hand vacuum cleaner that uses a cyclone. It will be appreciated that the vacuum cleaner 100 may be of various types (e.g., an upright vacuum cleaner, a canister vacuum cleaner, an extractor, etc.) and configurations (e.g., different positioning and orientation of the cyclone unit and the suction motor and differing cyclone units that may comprise one or more cyclones and one or more filters).

Referring to FIGS. 1 to 7B, a first example of a surface cleaning apparatus 100 is shown. The surface cleaning apparatus 100 (also referred to herein as vacuum cleaner or cleaner 100) is a hand vacuum cleaner 100, and is movable along a surface to be cleaned by gripping and maneuvering handle 102. The vacuum cleaner 100 includes an upper portion 104, a lower portion 106, a front end 108, and a rear end 110. In the example shown, handle 102 is provided at the upper portion 104. In alternate examples, handle 102 may be provided elsewhere on the vacuum cleaner 100, for example at the rear end 110, and may be of any design.

In the example shown, the vacuum cleaner 100 comprises a nozzle 112 and a cyclone unit 114, which together form a surface cleaning head 116 of the vacuum cleaner 100. In the example shown, the surface cleaning head 116 is preferably provided at the front end 108 of the vacuum cleaner 100.

Nozzle 112 engages a surface to be cleaned, and comprises a dirty air inlet 118, through which dirty air is drawn into the vacuum cleaner 100. An airflow passage extends from the dirty air inlet 118 to a clean air outlet 120 of the cleaner 100. In the example shown, clean air outlet 120 is at the rear end 110 of the cleaner 100.

Cyclone unit 114 is provided in the airflow passage, downstream of the dirty air inlet 118. In the example shown, the cyclone unit 114 is a one piece assembly comprising one cyclone 122, and one dirt collection chamber 124, which are integrally formed. In alternate examples, the cyclone unit 114 may include more than one cyclonic stage, wherein each cyclonic stage comprising one or more cyclones and one or more dirt chambers. Accordingly, the cyclones may be arranged in parallel and/or in sequence. Further, in alternate examples, the cyclone 122 and dirt collection chamber 124 may be separately formed.

In the example shown, the nozzle 112 is positioned at the lower portion 106 of the vacuum cleaner 100. Preferably, as exemplified, nozzle 112 is positioned at the bottom of the vacuum cleaner 100, and, preferably, beneath the cyclone unit 114. However, it will be appreciated that nozzle 112 may be connected to the cyclone unit or dirt collection chamber at alternate locations.

Figure 6:
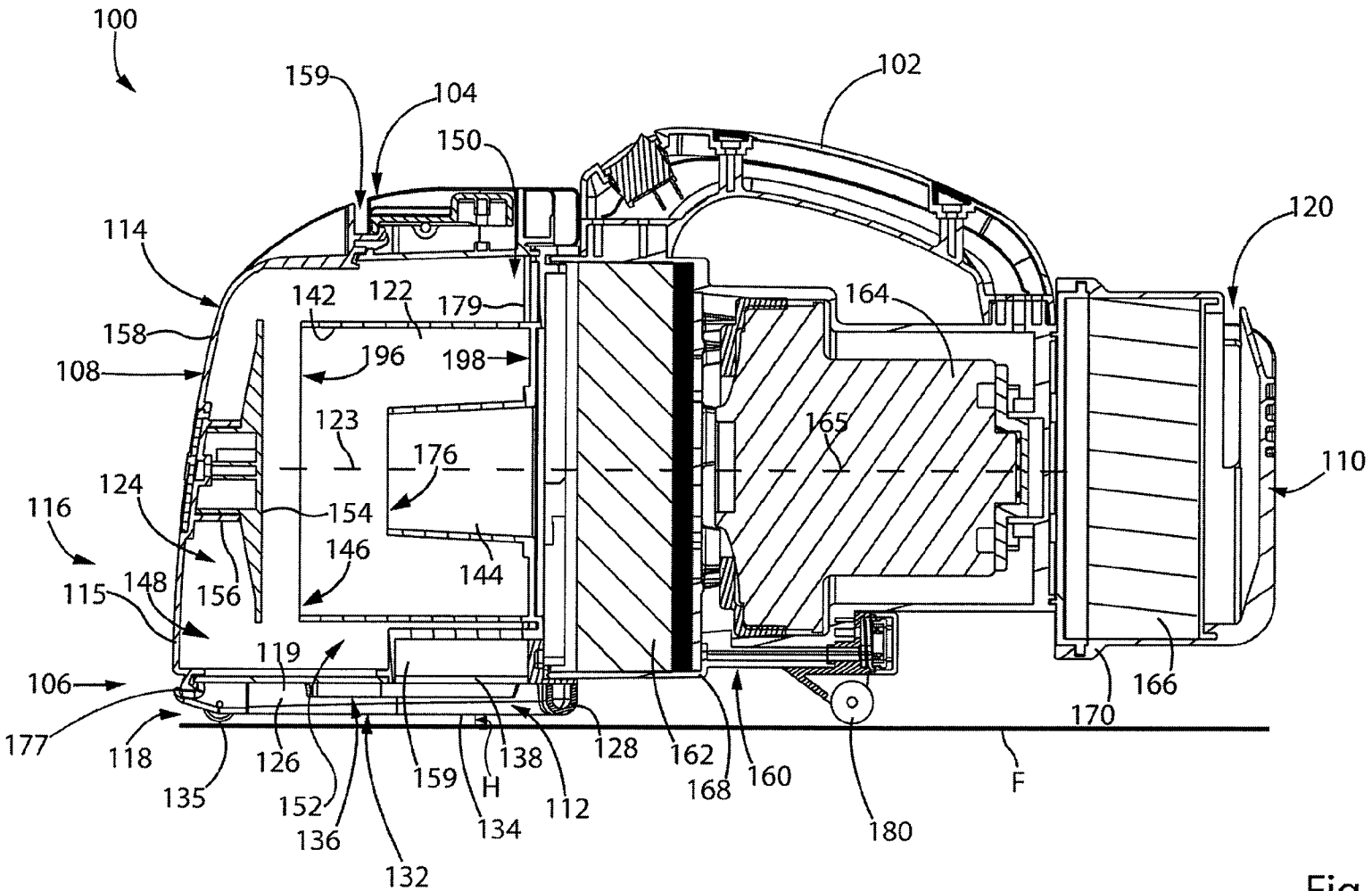
FIG. 6 is a cross section taken along line 6-6 in FIG. 2.

Preferably, as exemplified, nozzle 112 may be on lower surface 157 of cyclone unit 114 and may share a wall with the cyclone unit 114. For example in a particularly preferred design, the upper wall of the nozzle may be a lower wall of the cyclone unit 114. As shown in FIG. 6, dirt chamber 124 surrounds the lower portion of cyclone 122. Accordingly, the upper wall of nozzle 112 may be part of the lower wall of the dirt chamber. It will be appreciated that if dirt chamber 124 does not extend around the lower portion of cyclone 122, then the upper wall of nozzle 112 may be part of a lower wall of cyclone 122.

Preferably, in the example shown, the nozzle 112 is fixedly positioned at the lower portion 106 of the vacuum cleaner 100. That is, the nozzle 112 is not movable (e.g., rotatable) with respect to the remainder of the vacuum cleaner 100, and is fixed at the lower portion 106 of the vacuum cleaner 100.

Figure 3:
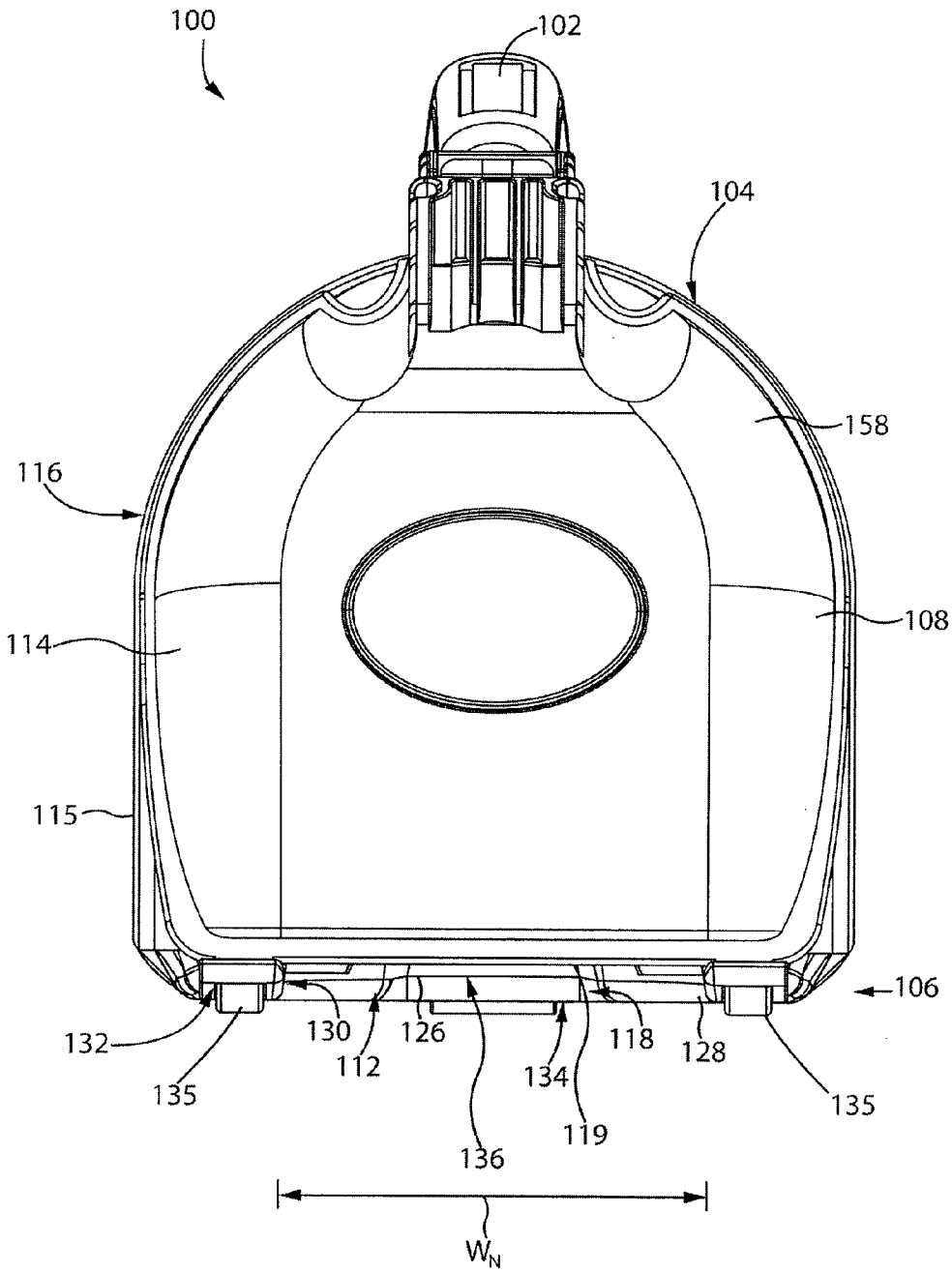
FIG. 3 is a front plan view of the hand vacuum cleaner of FIG. 1.
Figure 4:
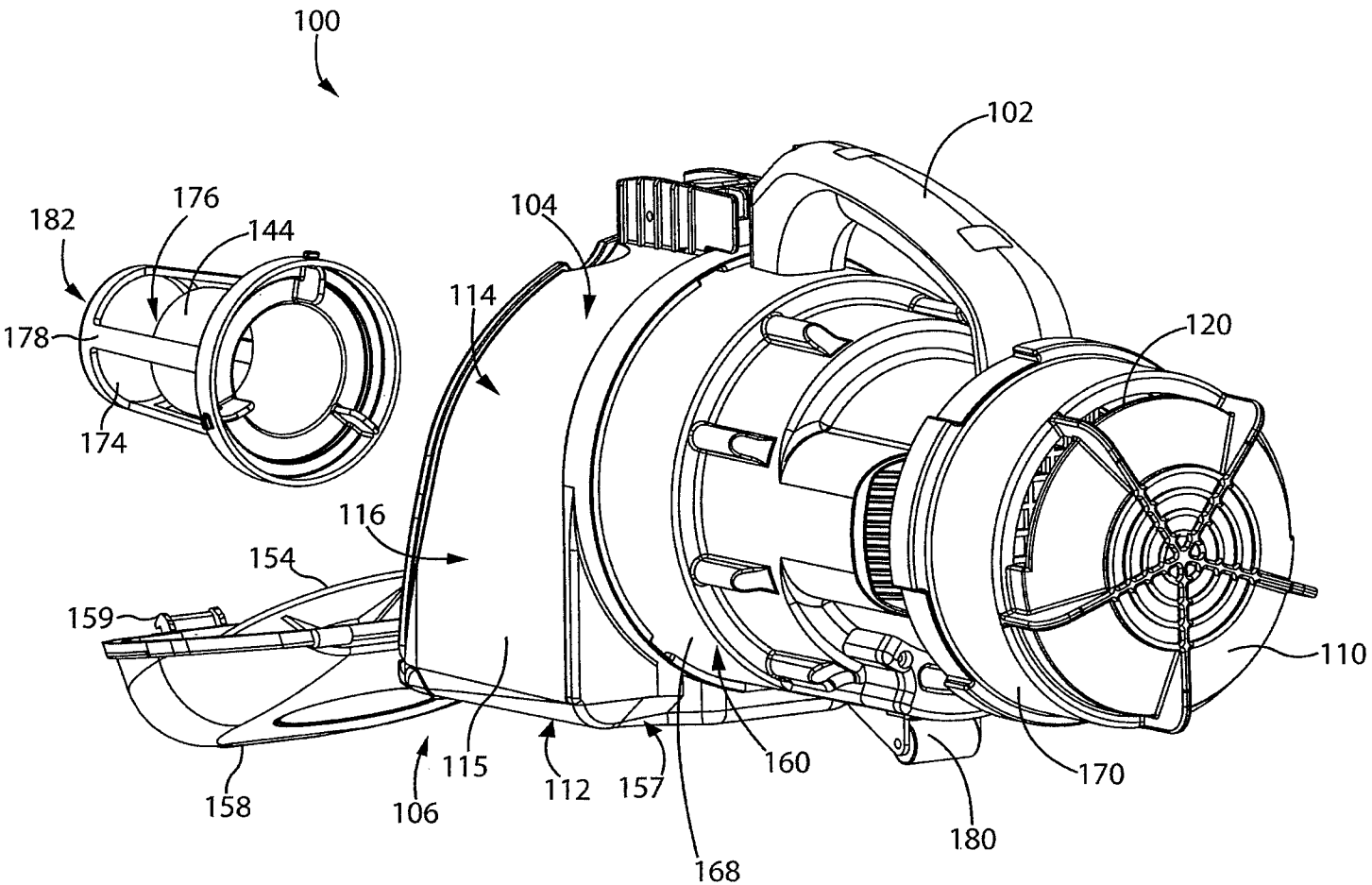
FIG. 4 is a partially exploded rear perspective view of the hand vacuum cleaner of FIG. 1.
Figure 5A:
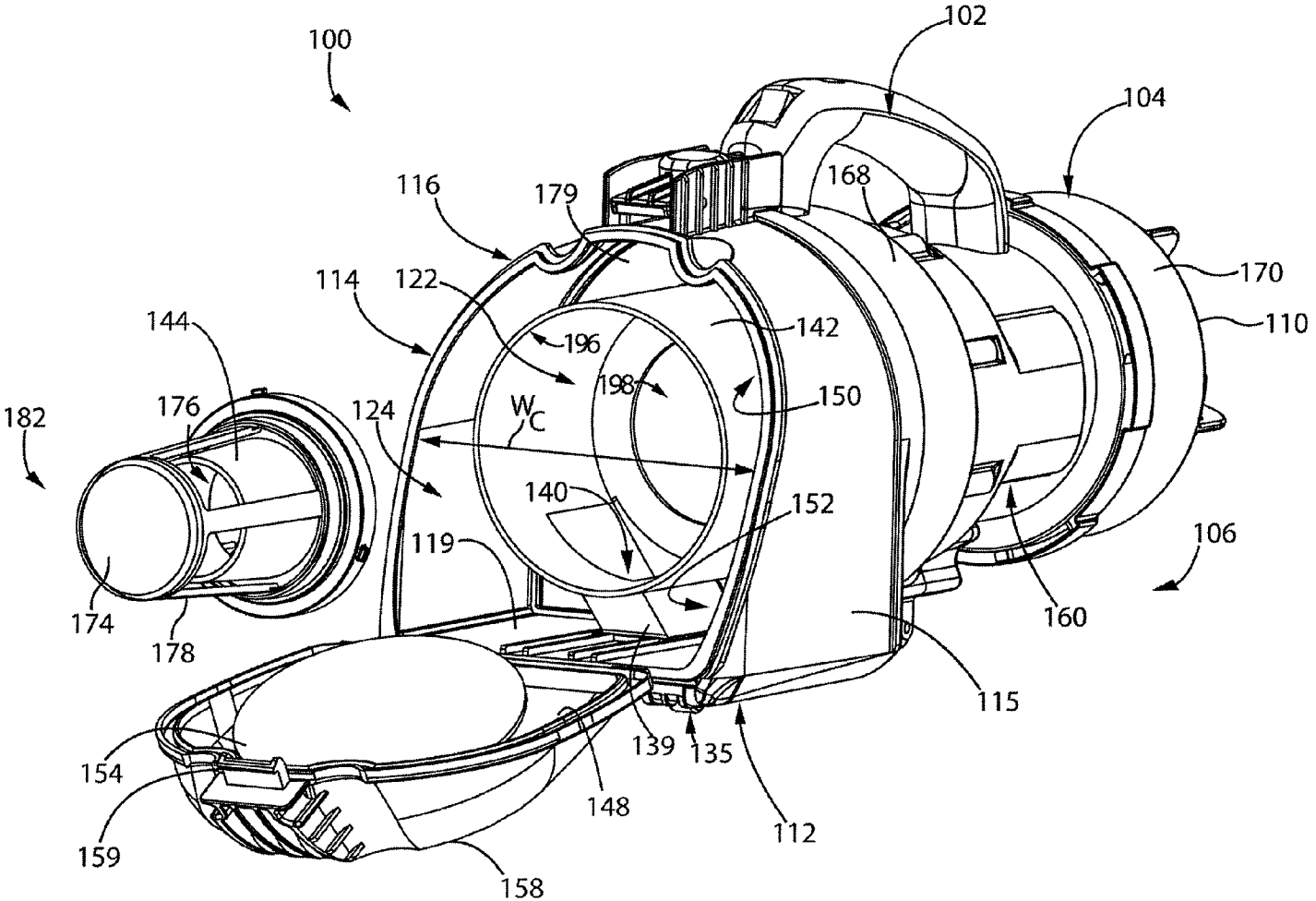
FIG. 5A is a front perspective view of the hand vacuum cleaner of FIG. 1, showing a door in an open configuration.
Figure 5B:
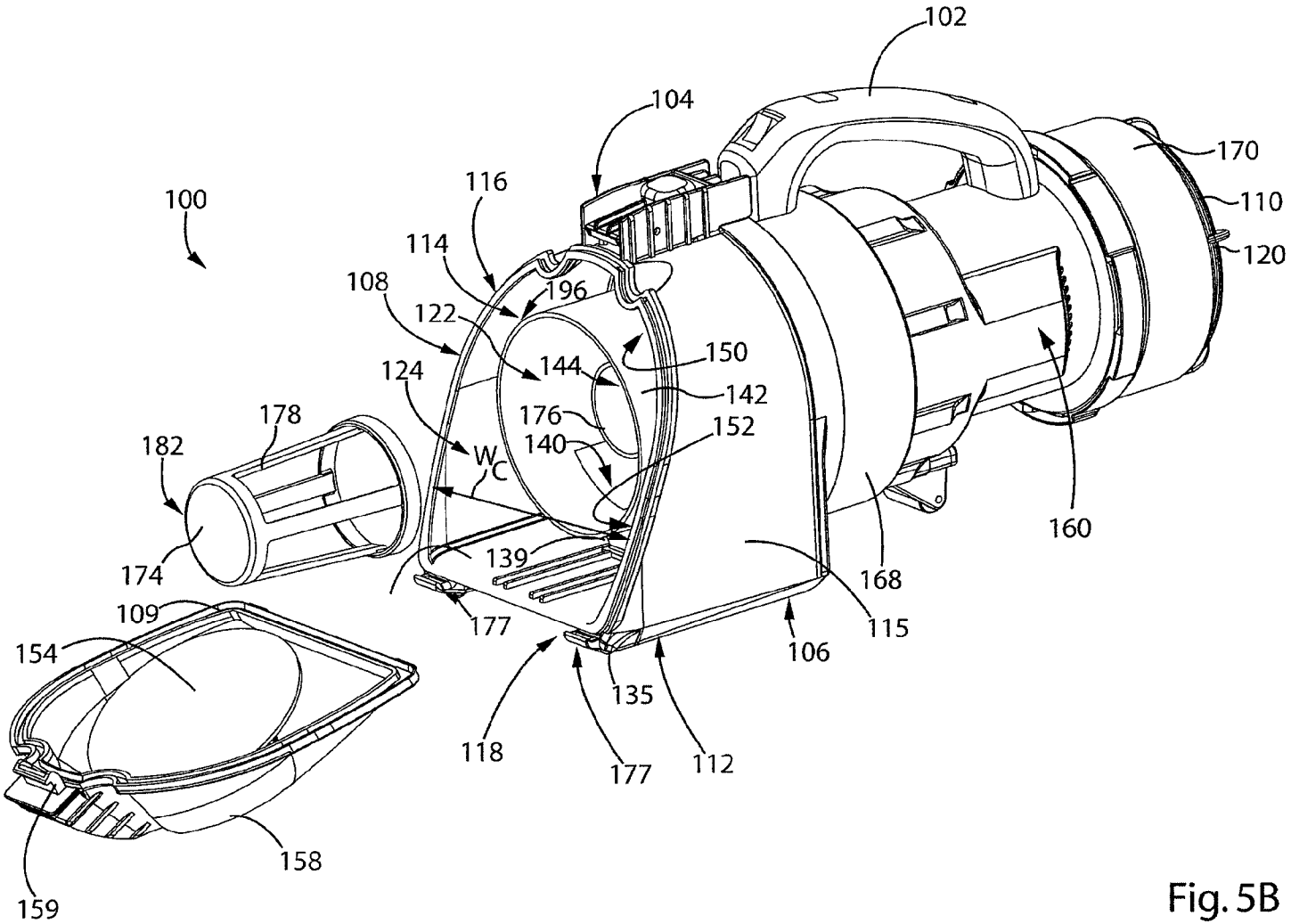
FIG. 5B is a front perspective view of the hand vacuum cleaner of FIG. 1, showing a door removed from the hand vacuum cleaner.

As shown in FIGS. 3 and 5, nozzle 112 has a width WN, and cyclone unit 114 has a width WC. In the example shown, WN, and WC are about the same. An advantage of this design is that the nozzle 112 may have a cleaning path that is essentially as wide as the hand vacuum itself.

Preferably, nozzle 112 comprises an airflow chamber 136 wherein at least a portion, and preferably a majority, of the lower surface of the chamber 136 is open. In an alternate design as exemplified by FIG. 8, nozzle 812 comprises a lower wall 837, which closes lower end 834. Accordingly, nozzle 112 may be of various designs and may be an open sided passage or a closed passage. In either embodiment, it will be appreciated that nozzle 112 is mounted or provided on cyclone unit 114 and as exemplified on a lower portion of the dirt collection chamber so as to be removable with the dirt collection chamber.

Figure 7A:
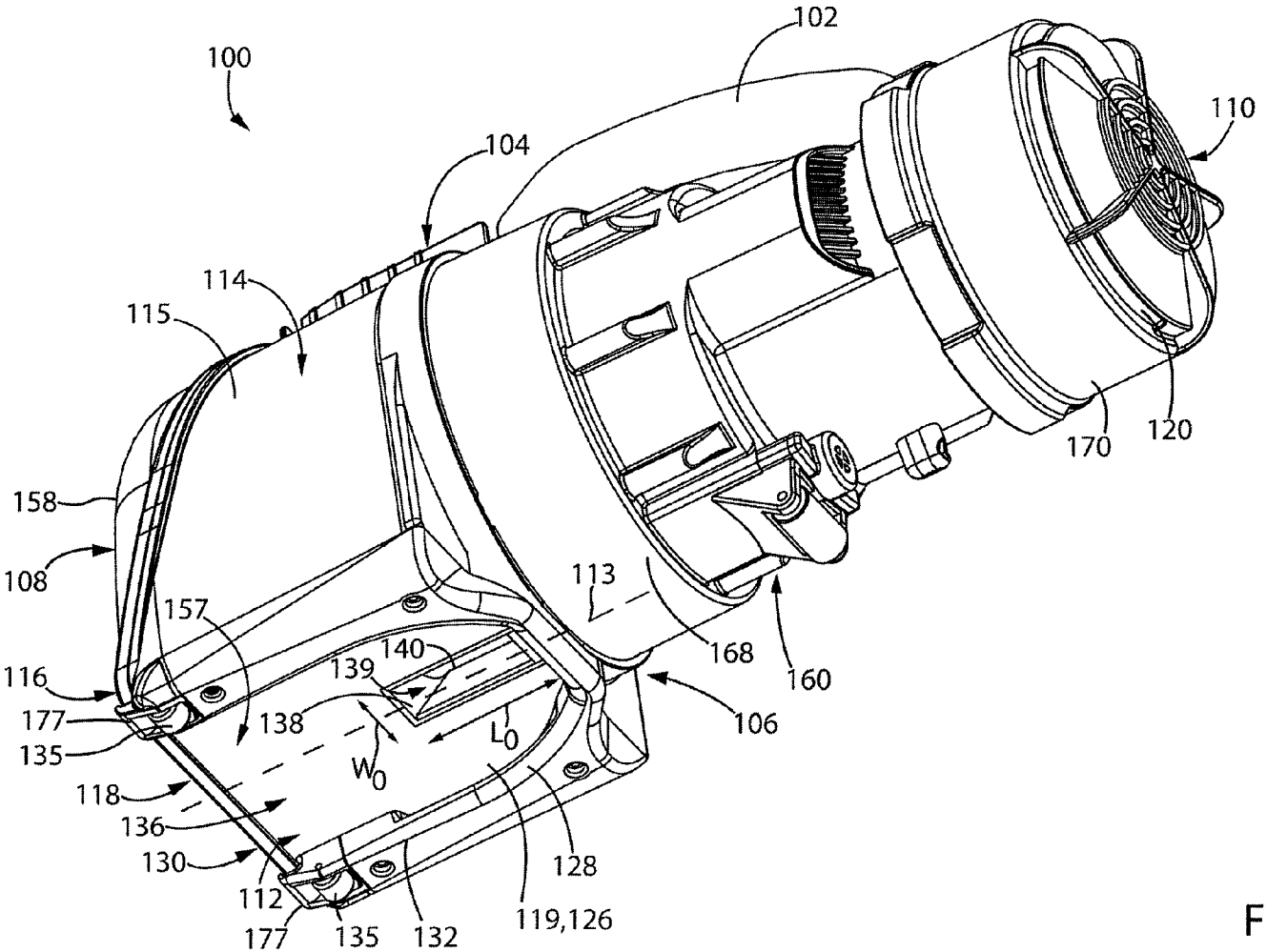
FIG. 7A is a bottom perspective view of the hand vacuum cleaner of FIG. 1.

An open sided nozzle design is exemplified in FIG. 7A wherein nozzle 112 comprises an upper nozzle wall 126. In the example shown, the upper nozzle wall 126 comprises a portion 119 of a wall 115 of the cyclone unit. Accordingly, nozzle 112 is integral with cyclone unit 114.

Preferably, one or more depending walls 128 extend downwardly from the upper nozzle wall 126. The depending wall 128 is preferably generally U-shaped. In one embodiment, depending wall is provided rearward of opening 138. In other embodiments, depending walls may alternately or in addition be provided on the lateral sides of opening 138. It is preferred that depending walls are provided on each lateral side of opening 138 and rearward thereof. Further, depending walls 128 may extend a substantial distance to the front end 108 and, preferably, essentially all the way to front end 108. The depending wall 128 may be continuous to define a single wall as shown, or may be discontinuous. The depending wall 128 is preferably rigid (e.g., integrally molded with cyclone unit 114). However, they may be flexible (e.g., bristles or rubber) or moveably mounted to cyclone unit 114 (e.g., hingedly mounted).

Preferably, the lower end 132 of depending wall 128 is spaced above the surface being cleaned when the hand vacuum cleaner is placed on a surface to be cleaned. As exemplified in FIG. 6, when vacuum cleaner 100 is placed on a floor F, lower end 132 of depending wall 128 is spaced a distance H above the floor. Preferably distance H is from 0.01 inches to 0.175 inches, and preferably from 0.04 to 0.08 inches.

The height of the depending wall (between upper nozzle wall 126 and lower end 132) may vary. In some examples, the depending wall may have a height of between about 0.05 inches and about 0.875 inches, preferably between about 0.125 inches and about 0.6 inches and more preferably between about 0.2 inches and about 0.4 inches. The height of depending wall may vary but is preferably constant.

As exemplified, the open end of the U-shape defines an open side 130 of the nozzle 114, and forms the dirty air inlet 118 of the cleaner 100. In the example shown, the open side 130 is provided at the front of the nozzle 114. In use, when optional wheels 135 are in contact with a surface, the open side 130 sits above and is adjacent a surface to be cleaned (e.g. floor F). As mentioned hereinabove, preferably, lower end 132 of depending walls 128 is spaced above floor F. Accordingly, some air may enter nozzle 114 by passing underneath depending wall 132. In such a case, the primary air entry to nozzle 114 is via open side 130 so that dirty air inlet 118 is the primary air inlet, with a secondary air inlet being under depending wall 128.

In the example shown, the lower end 132 of the depending wall 128 defines an open lower end 134 of the nozzle 114. The open lower end 134 preferably extends to the front 108 of the cleaner 108, and merges with the open side 130. In use, the exemplified nozzle has an open lower end 134 that faces a surface to be cleaned.

In the example shown, a plurality of wheels 135 are mounted to the depending wall 128, and extend lower than the lower end 132 of the depending wall 128. Accordingly, in use, when wheels 135 are in contact with a surface, the lower end 132 of the depending wall 128 is spaced from the surface to be cleaned, and the space between the lower end of the depending wall 128 and the surface to be cleaned form the secondary dirty air inlet to the vacuum cleaner 100. It will be appreciated that wheels 135 are optional. Preferably, wheels 135 are positioned exterior to the airflow path through nozzle 112, e.g., laterally outwardly from depending wall 128. Preferably a pair of front wheels 135 are provided. Preferably, the wheels are located adjacent front 108. Optionally, one or more rear wheels 108 may be provided. In an alternate embodiment, no wheels may be provided.

The upper nozzle wall 126, depending wall 128, and open lower end 134 of the nozzle 112 define the open sided airflow chamber 136 of the nozzle. In use, when wheels 135 are in contact with a horizontal surface, the nozzle 112 and the airflow chamber 136 extend generally horizontally, and preferably linearly along a nozzle axis 113 (see FIG. 7A).

An opening 138 is provided in the upper nozzle wall 126, and is in communication with the airflow chamber 136. Opening 138 may be of any size and configuration and at various locations in upper nozzle wall 126. In use, when wheels 135 are in contact with a surface, the opening 138 faces a surface to be cleaned, air enters the dirty air inlet 118, passes horizontally through the airflow chamber 136, and passes into the opening 138. Opening 138 is in communication with a cyclone inlet passage 139, which is in communication with a cyclone air inlet 140 of cyclone 122.

Cyclone 122 may of any configuration and orientation. Preferably, cyclone 122 comprises a chamber wall 142, which in the example shown, is cylindrical. The cyclone chamber is located inside chamber wall 142. The cyclone 122 extends along an axis 123, which, in the example shown, is preferably parallel to the nozzle axis, and preferably extends generally horizontally when cleaner 100 is in use and wheels 135 are seated on a surface. Cyclone 122 has a first end 196, which in the example shown is the front of the cyclone, and a second end 198, which in the example shown is a rear 198 of the cyclone.

Preferably, the cyclone air inlet and the cyclone air outlet are at the same end of the cyclone 122 and the dirt outlet is at an opposed end. The cyclone air outlet may be covered by a screen or shroud or filter as is known in the art. As exemplified, the cyclone air inlet 140 is defined by an aperture in the chamber wall 142, and is at the rear 198 of the cyclone 122. As can be seen in FIG. 5, the inlet passage 139 is configured such that air enters the cyclone 122 in a tangential flow path, e.g., passage 139 may be arcuate. The air travels in a cyclonic path in the cyclone, and dirt in the air is separated from the air. The air exits the cyclone via an outlet passage 144, through outlet 145. Outlet 145 is defined in a rear wall 179 of the cyclone unit 114. Accordingly, cyclone inlet 140 and outlet 145 are at the same end of the cyclone 122.

As exemplified in FIG. 6, a plate 174 may be provided adjacent outlet passage 144, spaced from and facing the inlet 176 to outlet passage 144. Plate 174 may be mounted to cyclone 122 via legs 178. In the example shown, plate 174, and legs 178 form an assembly 182 that is removably mounted in cyclone 122. In some examples, a screen may be mounted around legs 178.

The dirt that is separated from the air exits the cyclone via dirt outlet 146, and enters dirt collection chamber 124. Dirt outlet is at the front 196 of the cyclone 122, and further, is at the front end 108 of the cleaner 100. The dirt collection chamber may be internal or external to the cyclone chamber. Preferably, as exemplified, the dirt collection chamber is external. The dirt collection chamber may be in communication with the cyclone chamber by any means known in the art. Accordingly, one or more dirt outlets may be provided.

In the example shown, dirt collection chamber 124 comprises two portions. A first portion 148 is provided immediately adjacent the dirt outlet 146, and is at the front end 108 of the cleaner 100. A second portion 150 is concentric with the cyclone 122. A lower portion 152 of the second portion 150 is below the cyclone. As exemplified, nozzle 112 is positioned below first portion 148, and lower portion 152. Accordingly, dirt chamber 124 may comprise an annular chamber surrounding the cyclone 122.

A separation plate 154 may be provided in the dirt collection chamber 124, adjacent the dirt outlet 146, and in facing relation to the dirt outlet. The separation plate 154 aids in preventing dirt in dirt collection chamber 124 from re-entering cyclone 122. Preferably, plate 154 is spaced from dirt outlet 146. Plate 154 may be mounted by any means to any component in cyclone unit 114. As exemplified, the separation plate is preferably mounted to front wall 158, such as by an arm 156, which extends from a front wall 158 at the front 108 of the cleaner 100.

Figure 5C:
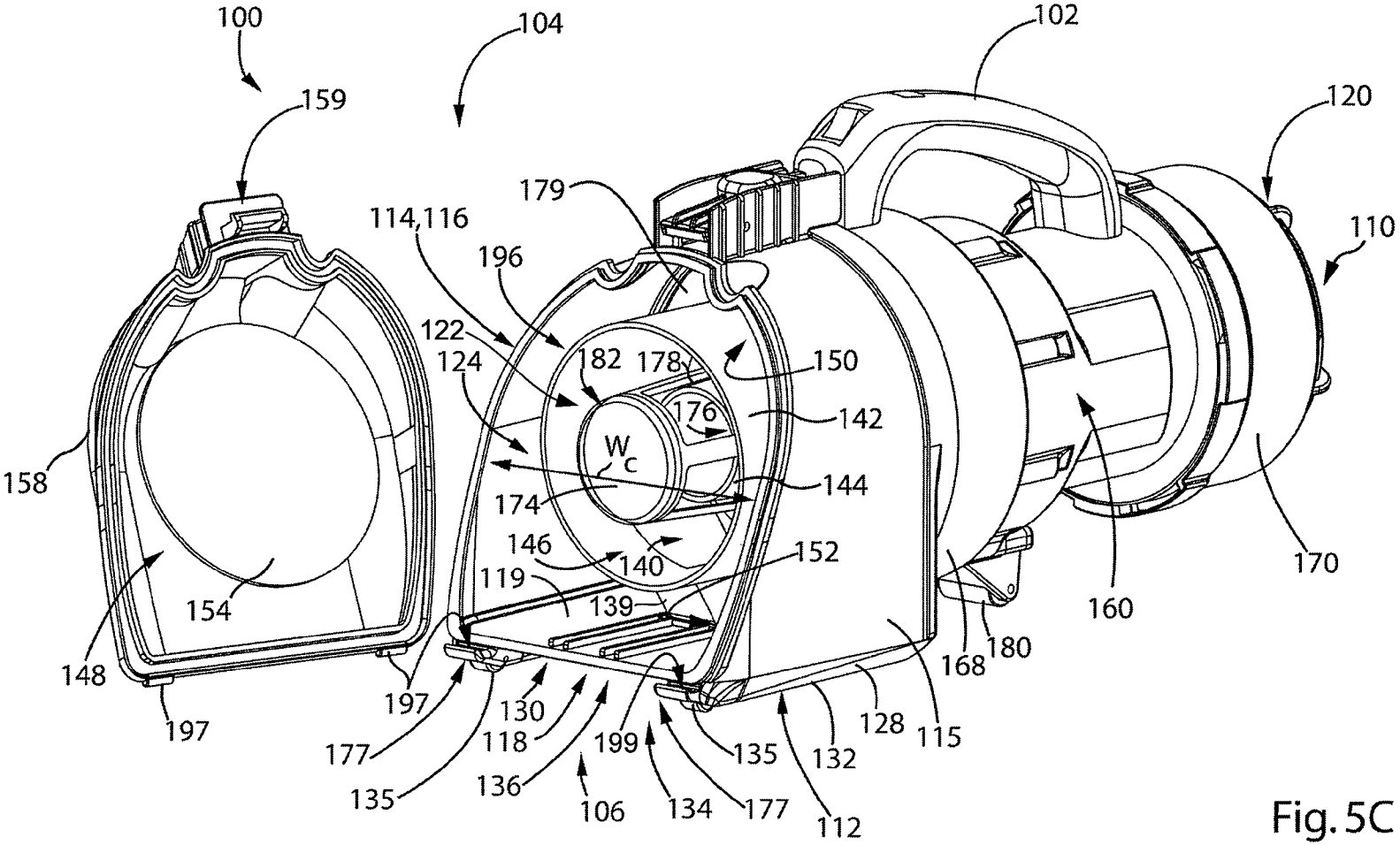
FIG. 5C is a front perspective view of the hand vacuum cleaner of FIG. 1, showing a door removed from the hand vacuum cleaner, and showing the door rotated with respect to the hand vacuum cleaner.

Cyclone unit 114 may be emptied by a removable door. The door may be removable while the cyclone unit is mounted to the vacuum cleaner. Alternately, or in addition, the door may be removable when the cyclone unit has been removed from the vacuum cleaner. The door may be removably secured to the cyclone unit or another portion of vacuum cleaner 100 by any means. For example, one or more latches 159 may secure the door in position. Alternately, the door may be opened, e.g., pivoted open, and then be removable. For example, as exemplified in FIGS. 4 to 5C, front wall 158 is pivotally mounted to the cyclone unit wall 115 at pivots 177 and serves as an openable door of the dirt chamber 124, such that dirt collection chamber 124 is openable, and dirt collection chamber 124 may be emptied. As shown in FIGS. 5C and 6, pivots 177 are separable into two portions. As exemplified, pivots 177 have an upper recess 199 that is semi circular in transverse section and define an axis in which an axle 197 provided on front wall 158 may rotate. When front wall 158 is pivoted to the open position, the axles 197 may be lifted off the pivots 177 thereby permitting front wall 158 to be lifted off the vacuum cleaner.

The removable door is preferably provided at the front of the vacuum cleaner, or on a surface that does not face another component of the vacuum cleaner. Accordingly, the dirt collection chamber is openable both when the dirt collection chamber is mounted to the hand vacuum cleaner, or when it is removed. When door is pivoted away or removed from the remainder of the cyclone unit 114, separation plate 154 and arm 156 also pivot away from the remainder of the cyclone unit.

The rear portion of the dirt collection chamber 124 may be closed by wall 179.

The clean air exiting cyclone 122 passes through outlet 145 of outlet passage 144, exits surface cleaning head 116, and passes into the cleaner body 160. In the example shown, the cleaner body 160 is positioned rearward of the surface cleaning head 116. The cleaner body comprises a suction motor housing 168, which houses an optional pre-motor filter 162, a suction motor 164 and may house an optional post-motor filter 166.

In the example shown, suction motor housing 168 further houses a pre-motor filter 162. Pre-motor filter 162 is provided in the airflow path adjacent and downstream of the outlet passage 144, and facing the outlet 145. Pre-motor filter 162 serves to remove remaining particulate matter from air exiting the cyclone 122, and may be any type of filter, such as a foam filter. One or more filters may be used. In the exemplified embodiments, the vacuum cleaner has a linear configuration. If the vacuum cleaner is of a non-linear configuration, then pre-motor filter 162 need not be located adjacent outlet passage 144.

Suction motor 164 is provided in the airflow path adjacent and downstream of the pre-motor filter 162. The suction motor 164 may be any type of suction motor. The suction motor draws air into the dirty air inlet 118 of the cleaner 100, through the airflow path past the suction motor 164, and out of the clean air outlet 120. The suction motor 164 has a motor axis 165. In the example shown, the motor axis 165 and the cyclone axis 123 preferably extend in the same direction and are preferably generally parallel. In the exemplified embodiments, the vacuum cleaner has a linear configuration. If the vacuum cleaner is of a non-linear configuration, then motor 164 need not be located adjacent pre-motor filter 162.

The cleaner body 160 further comprises a post-motor filter housing 170. A post motor filter 166 is provided in the post-motor filter housing 170. The post-motor filter 166 is provided in the airflow path downstream of, and preferably adjacent, the suction motor 164. Post motor filter 166 serves to remove remaining particulate mater from air exiting the cleaner 100. Post-motor filter 166 may be any type of filter, such as a HEPA filter. If the vacuum cleaner is of a non-linear configuration, then post motor filter 166 need not be located adjacent suction motor 164.

Clean air outlet 120 is provided downstream of post-motor filter 166. Clean air outlet 120 may comprise a plurality of apertures formed in housing 170.

Figure 7B:
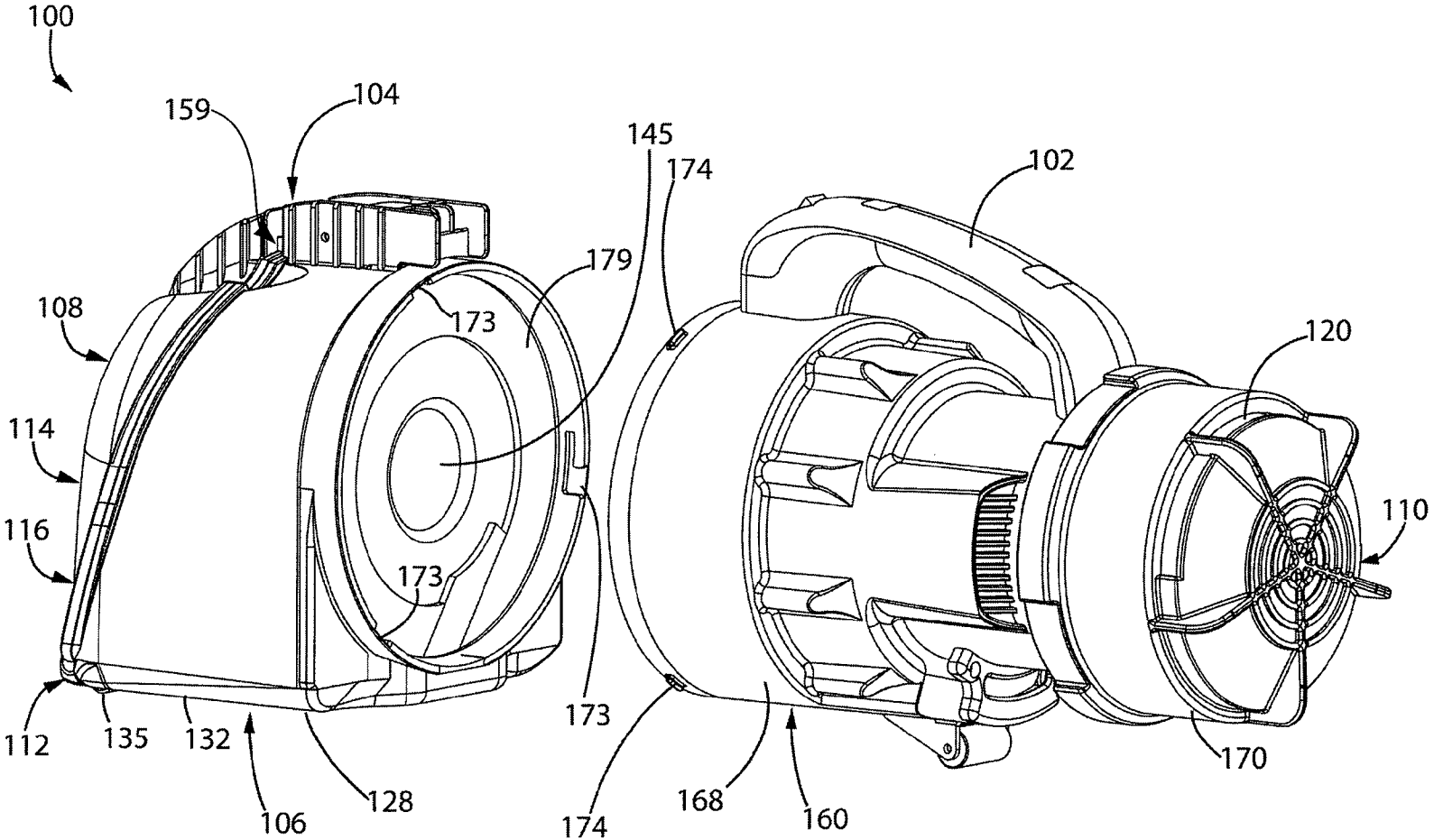
FIG. 7B is a rear perspective view of the hand-vacuum cleaner of FIG. 1, showing the cyclone unit removed from the hand vacuum cleaner; and, FIG. 8 is a cross section showing an alternate example of a hand vacuum cleaner.

Referring to FIG. 7B, the dirt collection chamber 124 is preferably removable from the hand vacuum cleaner 100 as a sealed unit for emptying. In the example shown, the cyclone unit 114 comprises the dirt collection chamber 124. Accordingly, the cyclone unit 114 is removable from the hand vacuum cleaner. As the cyclone unit 114 is integral with nozzle 112 and airflow chamber 136, nozzle 112 and airflow chamber 136 are removable from the cleaner 100 with cyclone unit 114.

As can be seen in FIG. 7B, when the cyclone unit 114 is removed from the hand vacuum cleaner, and particularly from motor housing 168, it is sealed, except for the fluid flow passages leading to and from the first cyclone unit (i.e. opening 138 and outlet 145). That is, wall 179 and front wall 158 seal the cyclone unit 114. In order to empty the dirt collection chamber 124, the front wall 158 may be removed, and the dirt may be emptied from dirt chamber 124.

As exemplified, in order to remove cyclone unit 114 from the surface cleaning apparatus, the cyclone unit comprises a first mounting member 173, and the suction motor housing 168 has a second mounting member 175. The first 173 and second 175 mounting members are releasably engageable with each other. In the example shown, the first 173 and second 175 mounting members comprise a bayonet mount. In alternate examples, the first and second mounting members may be another type of mounting member, such as mating screw threads, magnets, mechanical members such as screws or any other type of mounting members.

One or more additional wheels 180 may be mounted to housing 161, preferably at lower portion 106, and may be used in conjunction with wheels 135. Preferably, a single rear wheel 180 is provided. Preferably, rear wheel 180 is located on a centre line of the vacuum cleaner and rearward of the depending wall 128.

Figure 8:
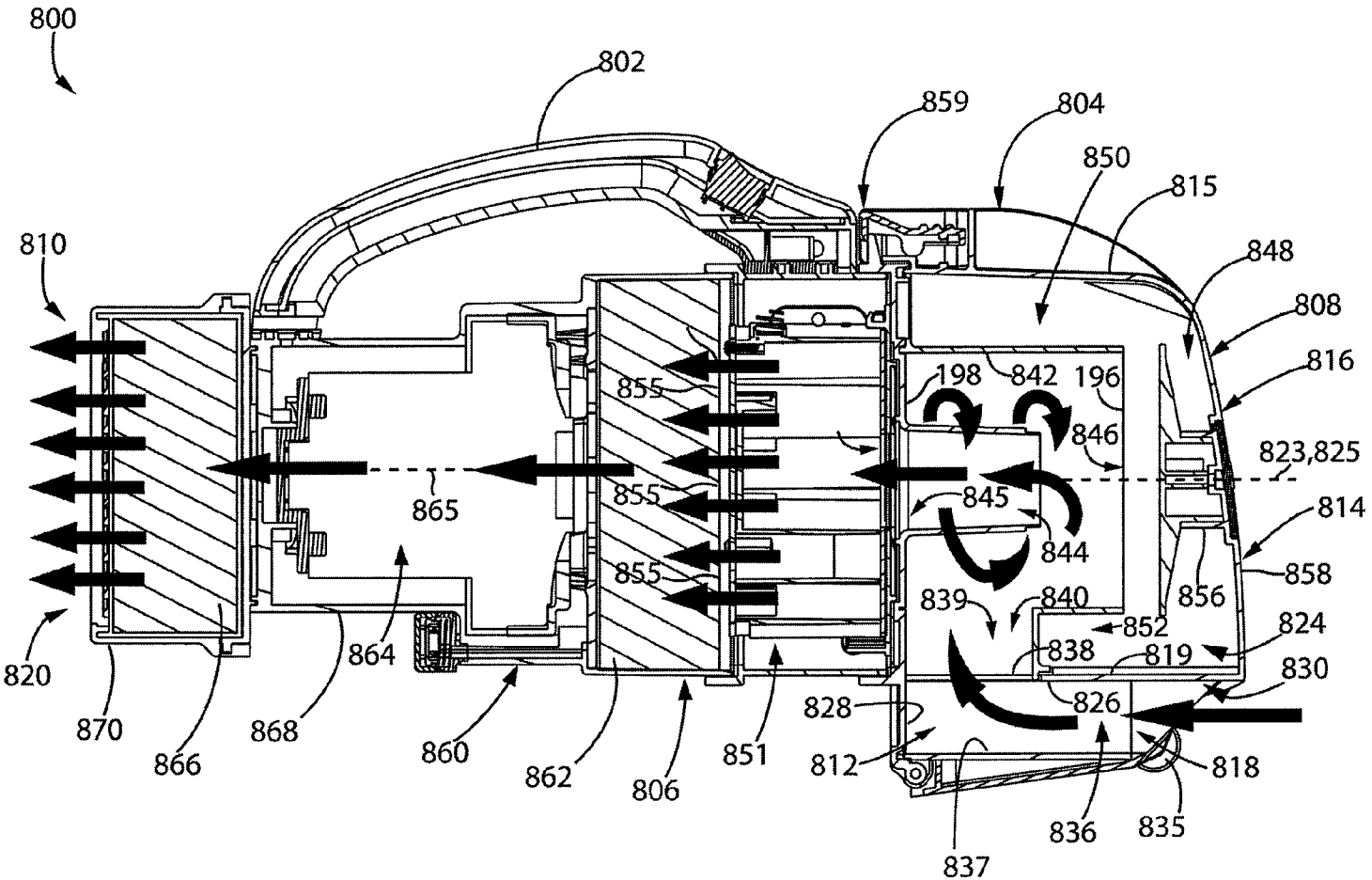

Referring now to FIG. 8, in which like numerals refer to like features, with the first digit incremented to 8 to refer to the figure number, an alternate example of a hand vacuum cleaner 800 is shown. As discussed previously, nozzle 812 comprises a lower wall 837, which closes lower end 834. Accordingly, in contrast to cleaner 100, nozzle 812 comprises an enclosed airflow passage 836. Further, in this example, cleaner 800 further comprises a second optional cyclone unit 851 downstream of the first cyclone unit 814, between first cyclone unit 814 and pre-motor filter 862. In the example shown, the second cyclone unit 851 comprises a plurality of cyclones in parallel. Each of the plurality of cyclones is parallel to the first cyclone axis 823

The invention claimed is:

1. A hand vacuum cleaner surface cleaning apparatus comprising:

a) a front end and a rear end:

b) an air flow passage extending from a dirty air inlet to a clean air outlet;

c) a first cyclone unit positioned in the air flow passage, the first cyclone unit comprising at least one cyclone having a cyclone axis and at least one dirt collection chamber;

d) the dirt collection chamber having a removeably mounted door which defines a leading face of the hand vacuum cleaner and is positioned at a proximal end of the cyclone axis; and e) a suction motor positioned in the air flow passage.

2. The hand vacuum cleaner surface cleaning apparatus of claim 1 wherein the at least one dirt collection chamber is openable when mounted to the hand vacuum cleaner surface cleaning apparatus.

3. The hand vacuum cleaner surface cleaning apparatus of claim 1 wherein the surface cleaning apparatus comprises a hand vacuum cleaner and the first cyclone unit is positioned forward of the suction motor.

4. The hand vacuum cleaner surface cleaning apparatus of claim 1 wherein the surface cleaning apparatus comprises a hand vacuum cleaner, the at least one cyclone has a cyclone front end, a cyclone rear end, a cyclone air inlet and a cyclone air outlet and the cyclone air inlet and the cyclone air outlet are at the same end.

5. The hand vacuum cleaner surface cleaning apparatus of claim 4 wherein the cyclone air inlet and the cyclone air outlet are at the cyclone rear end.

6. The hand vacuum cleaner surface cleaning apparatus of claim 4 wherein the cyclone has a dirt outlet and a separation plate is mounted in facing relation to the dirt outlet.

7. The hand vacuum cleaner surface cleaning apparatus of claim 6 wherein the separation plate is mounted to the door.

8. The hand vacuum cleaner surface cleaning apparatus of claim 4 wherein the cyclone has a dirt outlet and a separation plate is mounted in facing relation to the dirt outlet and the dirt outlet is positioned at the cyclone front end and the cyclone front end is positioned at the front end of the hand vacuum cleaner.

9. The hand vacuum cleaner surface cleaning apparatus of claim 1 wherein the at least one cyclone has a first end, a second end, a cyclone air inlet and a cyclone air outlet and the cyclone air inlet and the cyclone air outlet are at the same end.

10. The hand vacuum cleaner surface cleaning apparatus of claim 1 wherein the dirt collection chamber is removable from the surface cleaning apparatus as a sealed unit for emptying.

11. The hand vacuum cleaner surface cleaning apparatus of claim 10 wherein the first cyclone unit is sealed when removed from the surface cleaning apparatus other than fluid flow passages leading to and from the first cyclone unit.

12. The hand vacuum cleaner surface cleaning apparatus of claim 1 wherein the dirt collection chamber is removable from the surface cleaning apparatus with the first cyclone unit.

13. The hand vacuum cleaner surface cleaning apparatus of claim 1 wherein the first cyclone unit has a single cyclone and a single dirt collection chamber.

14. The hand vacuum cleaner surface cleaning apparatus of claim 13 wherein the single dirt collection chamber is positioned exterior to the single cyclone.

15. The hand vacuum cleaner surface cleaning apparatus of claim 14 wherein the single cyclone and the single dirt collection chamber comprise a one-piece assembly.

16. The hand vacuum cleaner surface cleaning apparatus of claim 15 wherein the single cyclone and the single dirt collection chamber are integrally formed.

17. The hand vacuum cleaner surface cleaning apparatus of claim 1 further comprising a suction motor housing, the suction motor is positioned in the suction motor housing and the first cyclone unit is removably mounted to the suction motor housing.

18. The hand vacuum cleaner surface cleaning apparatus of claim 1 further comprising an airflow chamber extending from a dirty air inlet and in communication with a cyclone inlet, wherein the airflow chamber is removable with the first cyclone unit.

19. The hand vacuum cleaner surface cleaning apparatus of claim 18 wherein the airflow chamber is integrally formed as part of the first cyclone unit.

20. The hand vacuum cleaner surface cleaning apparatus of claim 1 further comprising a second cyclone unit downstream from the first cyclone unit.

21. A surface cleaning apparatus comprising:

a) a front end and a rear end:

b) an air flow passage extending from a dirty air inlet to a clean air outlet;

c) a first cyclone unit positioned in the air flow passage, the first cyclone unit comprising at least one cyclone and at least one dirt collection chamber;

d) the dirt collection chamber having a removeably mounted door, the door being receivable at one end in a recess provided on the surface cleaning apparatus and another end of the door being securable to the surface cleaning apparatus; and, e) a suction motor positioned in the air flow passage.

22. The surface cleaning apparatus of claim 21 wherein the surface cleaning apparatus comprises a hand vacuum cleaner and the door is removably mounted to the front end of the dirt collection chamber.

23. The surface cleaning apparatus of claim 21 wherein the surface cleaning apparatus comprises a portable vacuum cleaner and the cyclone has a cyclone axis that is horizontal.

* * * * *

UNITED STATES PATENT AND TRADEMARK OFFICE

CERTIFICATE OF CORRECTION

PATENT NO. : 8,510,907 B2
APPLICATION NO. : 12/721480
DATED : August 20, 2013
INVENTOR(S) : Wayne Ernest Conrad It is certified that error appears in the above-identified patent and that said Letters Patent is hereby corrected as shown below:

In the Claims

Column 9, line 16 claim 1 "A hand vacuum cleaner surface cleaning apparatus comprising:" should read --A hand vacuum cleaner comprising:--.

Column 9, line 29 claim 2 "The hand vacuum cleaner surface cleaning apparatus of..." should read --The hand vacuum cleaner of...--

Column 9, line 33 claim 3 "The hand vacuum cleaner surface cleaning apparatus of..." should read --The hand vacuum cleaner of...--

Column 9, line 34 claim 3 "wherein the surface cleaning apparatus comprises a hand vacuum cleaner and the first cyclone..." should read --wherein the first cyclone...--

Column 9, line 37 claim 4 "The hand vacuum cleaner surface cleaning apparatus of..." should read --The hand vacuum cleaner of...--

Column 9, line 43 claim 5 "The hand vacuum cleaner surface cleaning apparatus of..." should read --The hand vacuum cleaner of...--

Column 9, line 46 claim 6 "The hand vacuum cleaner surface cleaning apparatus of..." should read --The hand vacuum cleaner of...--

Column 9, line 49 claim 7 "The hand vacuum cleaner surface cleaning apparatus of..." should read --The hand vacuum cleaner of...--

Column 9, line 51 claim 8 "The hand vacuum cleaner surface cleaning apparatus of..." should read --The hand vacuum cleaner of...--

Signed and Sealed this
Twenty-fourth Day of December, 2013

Margaret A. Focarino

Margaret A. Focarino
*Commissioner for Patents of the United States Patent and Trademark Office*

Column 9, line 57 claim 9 “The hand vacuum cleaner surface cleaning apparatus of...” should read --The hand vacuum cleaner of...--

Column 10, line 1 claim 10 “The hand vacuum cleaner surface cleaning apparatus of...” should read --The hand vacuum cleaner of...--

Column 10, line 5 claim 11 “The hand vacuum cleaner surface cleaning apparatus of...” should read --The hand vacuum cleaner of...--

Column 10, line 9 claim 12 “The hand vacuum cleaner surface cleaning apparatus of...” should read --The hand vacuum cleaner of...--

Column 10, line 13 claim 13 “The hand vacuum cleaner surface cleaning apparatus of...” should read --The hand vacuum cleaner of...--

Column 10, line 16 claim 14 “The hand vacuum cleaner surface cleaning apparatus of...” should read --The hand vacuum cleaner of...--

Column 10, line 19 claim 15 “The hand vacuum cleaner surface cleaning apparatus of...” should read --The hand vacuum cleaner of...--

Column 10, line 22 claim 16 “The hand vacuum cleaner surface cleaning apparatus of...” should read --The hand vacuum cleaner of...--

Column 10, line 25 claim 17 “The hand vacuum cleaner surface cleaning apparatus of...” should read --The hand vacuum cleaner of...--

Column 10, line 30 claim 18 “The hand vacuum cleaner surface cleaning apparatus of...” should read --The hand vacuum cleaner of...--

Column 10, line 35 claim 19 “The hand vacuum cleaner surface cleaning apparatus of...” should read --The hand vacuum cleaner of...--

Column 10, line 38 claim 20 “The hand vacuum cleaner surface cleaning apparatus of...” should read --The hand vacuum cleaner of...--